US006953353B2

(12) United States Patent
Lemkuil

(10) Patent No.: US 6,953,353 B2
(45) Date of Patent: Oct. 11, 2005

(54) SAFETY PLUGS FOR POWER PORTS

(76) Inventor: Daniel J. Lemkuil, 5103 Stillbrooke Dr., Houston, TX (US) 77035

( * ) Notice: Subject to any disclaimer, the term of this patent is extended or adjusted under 35 U.S.C. 154(b) by 0 days.

(21) Appl. No.: 10/666,298

(22) Filed: Sep. 19, 2003

(65) Prior Publication Data

US 2005/0064755 A1 Mar. 24, 2005

(51) Int. Cl.[7] ..... H01R 13/639
(52) U.S. Cl. ..... 439/133; 439/148; 439/346
(58) Field of Search ..... 439/346, 133, 439/134, 148; 220/237, 3.8, 242

(56) References Cited

U.S. PATENT DOCUMENTS 3,640,422 A 2/1972 Harschel ..... 220/233
4,480,467 A 11/1984 Harter et al. ..... 73/204.15
5,344,329 A * 9/1994 Faller ..... 439/133
5,480,318 A * 1/1996 Garrison ..... 439/346
5,967,807 A * 10/1999 Wu ..... 439/131
6,682,356 B2 * 1/2004 Erez et al. ..... 439/135

FOREIGN PATENT DOCUMENTS

GB 2280895 A 2/1995 ..... B65D/39/12
GB 2292373 A 2/1996 ..... B65D/39/12

* cited by examiner

*Primary Examiner*—Renee Luebke
(74) *Attorney, Agent, or Firm*—Osha Liang LLP

(57) ABSTRACT

Safety plugs for power ports are disclosed. A safety plug in accordance with embodiments of the invention includes a body having a first end adapted to be inserted into a power port; a locking device connected to the body for reversibly engaging an inside of the power port; and a control device operatively coupled to the locking device for disengaging the locking device from the inside of the power port, wherein the control device comprises a child-resistant mechanism.

1 Claim, 3 Drawing Sheets

SAFETY PLUGS FOR POWER PORTS

BACKGROUND OF INVENTION

1. Field of the Invention

The invention relates generally to plugs for power ports. More particularly, the invention relates to safety plugs with a child-resistant mechanism.

2. Background Art

With more and more electronic devices, such as personal radios, cassette players, CD players, televisions, and DVD players, proliferating to our living environment outside the homes, new cars and boats often are equipped with multiple power ports. The days of having only one power port to be shared between a cigarette lighter and other electronic devices seem to be gone. While the additional power ports provide convenience to the users, they may present hazards to small children.

The additional power ports in the automobiles or boats are typically covered with simple devices to prevent foreign objects from being accidentally introduced into them. FIG. 1 shows one example of a typical cover used in most power ports. As shown, a cover 52, which is typically made of plastic, is attached to the opening 53 of the power port 51. The cover 52 is pressed into the opening 53 to close the power port. The cover 52 engages the power port by interference fit and can be easily removed by a curious child.

Once the cover 52 is opened, the electrical terminals (not shown) inside the power port 51 become accessible to the curious little hands and fingers. A child may stick his fingers into the power port. This may result in injuries to the child. Alternatively, the child may shove foreign objects into the power port. If paper clips or liquids are introduced into the power port, damages may result to the automobiles or boats, and the child may be injured.

Therefore, it is desirable that better power port covers or plugs that cannot be easily removed by children are available. In addition, it is desirable that such covers or plugs may serve other useful functions.

SUMMARY OF INVENTION

In one aspect, the invention relates to safety plugs for power ports such as those found in an automobile or a boat. A safety plug in accordance with one embodiment of the invention includes a body having a first end adapted to be inserted into a power port; a locking device connected to the body for reversibly engaging an inside of the power port; and a control device operatively coupled to the locking device for disengaging the locking device from the inside of the power port, wherein the control device comprises a child-resistant mechanism.

A safety plug in accordance with one embodiment of the invention may further include at least one electrical contact on the first end of the body for conducting electricity from the power port; and an electrical device disposed proximate to a second end of the body and electrically connected to the at least one electrical contact, wherein the electrical device is configured to be powered by the electricity from the power port.

Other aspects and advantages of the invention will be apparent from the following description and the appended claims.

DETAILED DESCRIPTION

Embodiments of the invention relate to safety plugs for power ports, such as those found in automobiles and boats. A safety plug in accordance with embodiments of the invention includes a locking device. The locking device can be disengaged by a control device with a child-resistant mechanism. Therefore, a safety plug in accordance with embodiments of the invention can prevent children from pulling the safety plug out of a power port.

Figure 1:
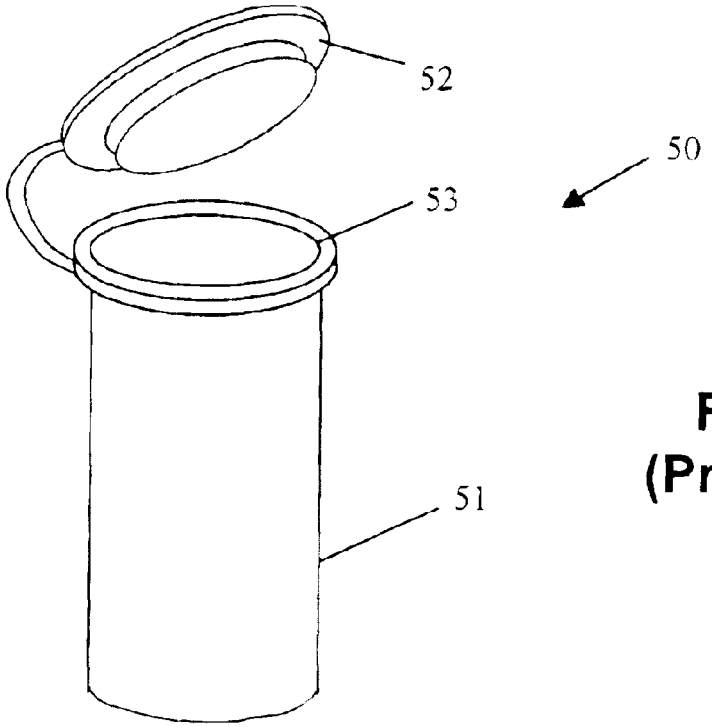
FIG. 1 (Prior Art)
FIG. 1 shows a prior art power port cover attached to a mobile power port.
Figure 2:
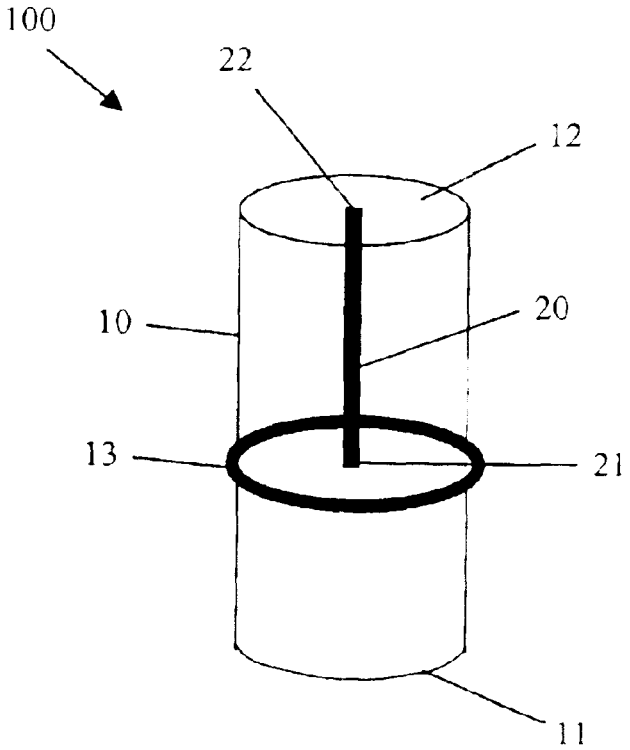
FIG. 2 shows a schematic of a safety plug in accordance with one embodiment of the invention.

FIG. 2 illustrates a schematic of a safety plug in accordance with one embodiment of the invention. As shown, the safety plug 100 comprises a body 10 that has a first end 11 and a second end 12. The first end 11 of the safety plug 100 is adapted to be inserted into a power port (or electric socket, shown as 51 in FIG. 1). The safety plug 100 also includes a locking device 13, which is controlled by a control device 20.

The locking device 13 engages the inside of the power port (socket) to prevent it from being removed. In preferred embodiments, the locking device 13 is configured to the locked state by default. Alternatively, the locking device 13 may be switched to the locked state after it is inserted into a power port. To remove the safety plug 100 from the power port, the control device 20 is activated. Activation of the control device 20 disengages the locking device 13 and converts it to the unlocked state to allow the safety plug 100 to be removed.

In accordance with embodiments of the invention, the control device 20 has a child-resistant mechanism that may be activated in a counter-intuitive manner such that a child is less likely to pull the safety plug 100 out of the power port. Examples of child-resistant mechanisms may include the following. The control device 20 may need to be "pushed" in, while the safety plug 100 is being "pulled" out of the power port. The control device 20 may need to be turned to a specific angular position, like a child-resistant medicine bottle, before the safety plug 100 can be removed from the power port, The control device 20 may need to be turned to one direction and then the other, like a combination lock, before the locking mechanism 13 is disengaged from inside the power port. One of ordinary skill in the art would appreciate that other variations of the child-resistant mechanism may be used with embodiments of the invention, and, therefore, the invention is not limited to these specific examples.

The control device 20, which may include a shaft slidably disposed in the body 10, is attached at its first end 21 to the locking device 13, while the second end of the control device 22 may protrude from the second end 12 of the body 10 of the safety plug 100. The protrusion of the second end 22 allows a force to be applied to rotate or push the control device 20 towards the first end 11 of the body 10. Thus, the force needed to unlock the locking device 13 is applied in an opposite or orthogonal direction relative to the force needed to pull the safety plug 100 out of a power port.

Figure 3:
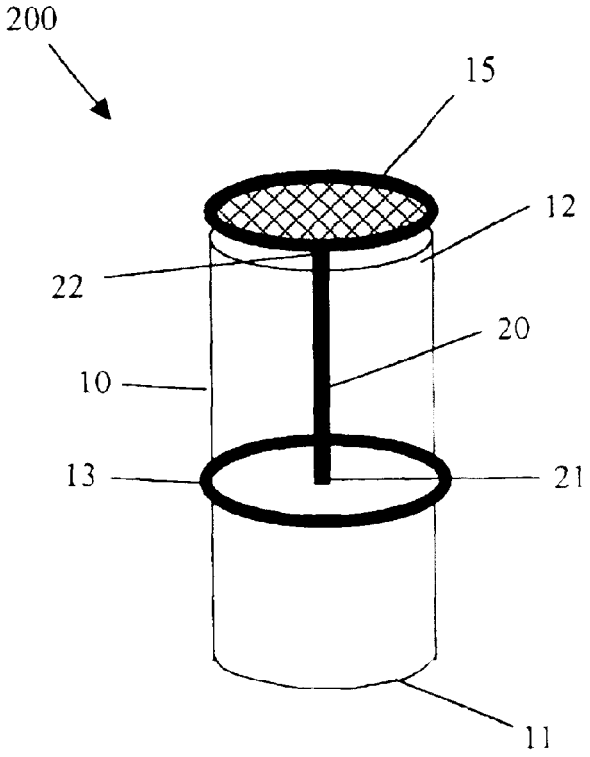
FIG. 3 shows a safety plug in accordance with another embodiment of the invention.

FIG. 2 illustrates minimum features of a safety plug 100 in accordance with one embodiment of the invention. According to some embodiments of the invention, the safety plug may further include other components to enhance its utility. As shown in FIG. 3, a safety plug 200 in accordance with one embodiment of the invention also includes an attachment 15. The attachment 15 may be attached to the second end 12 of the body 10 or to the second end 22 of the control device 20. If the attachment 15 is attached to the second end 12 of the body 10, then it may have an opening to allow access to the control device 20. Alternatively, the control device 20 may protrude from the side of the attachment 15.

The attachment 15 may be any item that enhances the utility and/or aesthetic of the safety plug 200, such as a picture, a display, a sign (e.g., a no smoking sign), an air freshener, a clock, or a connector for other electronic devices. If the attachment 15 is (or is for) an electronic or electrical device, such as a clock or any electronic device, or a connector for such a device, then the safety plug 200 may include conductors (electrical contacts) to transmit electricity from the power port. Examples of a display may include light-emitting diode display, a liquid-crystal display, a thin-film-transistor display, and a plasma display. Examples of an electrical connector may include a jack for a stereo mini plug, a jack for an RCA plug, etc.

Figure 4:
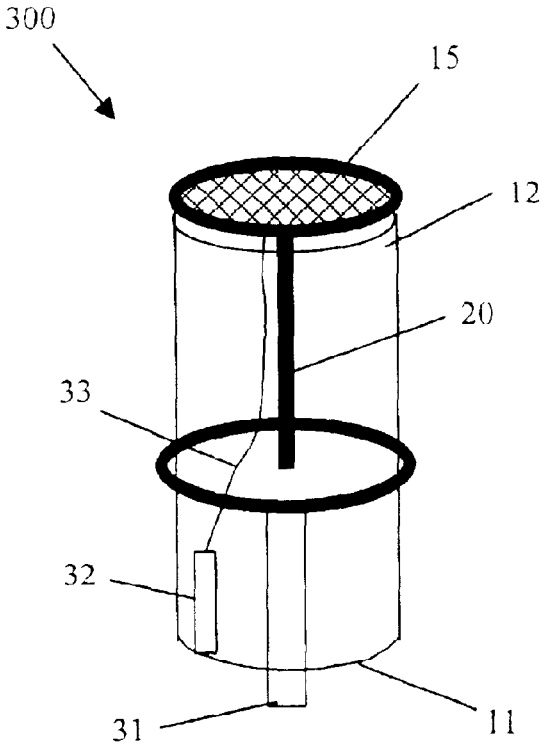
FIG. 4 shows a safety plug in accordance with another embodiment of the invention.

FIG. 4 shows a safety plug 300 in accordance with another embodiment of the invention. As shown, the safety plug 300 includes two conductors (electrical contacts) 31, 32 and a wire 33 for providing electrical power to the attachment 15. As shown, the electrical contact 31 is adapted to contact the positive terminal in the power port and the electrical contact 32 is to provide a current return. The current return electrical contact 32 may not be needed, if the body 10 is made of a conductive material and can provide the conductive path. If the control device 20 is made of a conductive material, the electrical contact 31 may be connected directly to the control device 20. Otherwise, the electrical contact 31 may be connected to the attachment 15 via a conductive wire (not shown).

Figure 5:
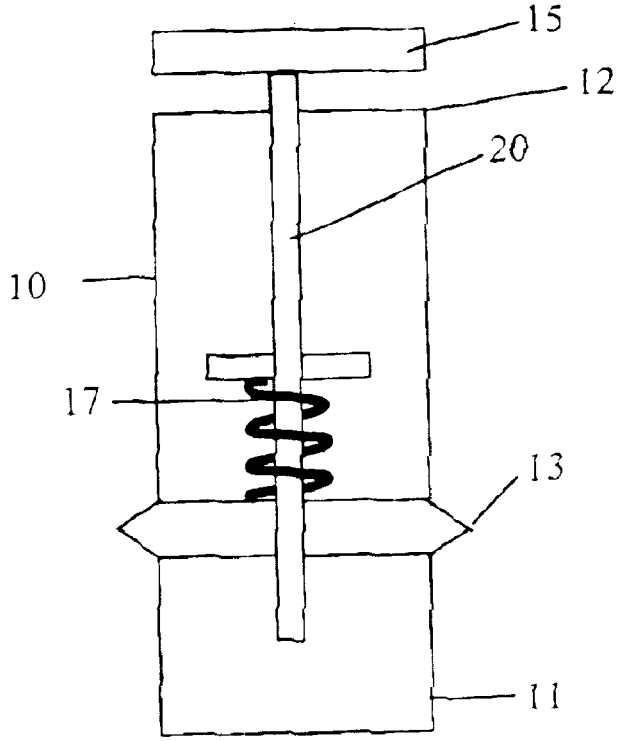
FIG. 5 shows a safety plug illustrating a locking device in accordance with one embodiment of the invention.

The locking device 13 may use any reversible mechanism that can prevent the safety plug from being pulled out of a power port by a child. FIG. 5 shows one embodiment of a locking device 13 that comprises an adjustable diameter member. As shown, the locking device 13 is made of a flexible material that is disposed between the first end 11 and the second end 12 of the body 10. The flexible material, for example, may be rubber, plastic, or the like. The flexible material permits the locking device 13 to change its diameter. While a single fold structure is illustrated for the locking device 13 in FIG. 5, one of ordinary skill in the art would appreciate that other configurations may be employed without departing from the scope of the invention. For example, the locking device 13 may have multiple folds as in an accordion, or other suitable structures.

As shown in FIG. 5, a spring 17 is provided to bias the control device 20 in the up position so that the locking device 13 is at its maximum diameter (i.e., the locked state). To unlock the safety plug 400 from a power port, the diameter of the locking device 13 can be reduced by pressing the control device 20 towards the first end 11 of the body 10. Thus, to remove the plug, two forces of opposite directions need to be applied. This counter-intuitive mechanism can prevent a child from pulling the safety plug out of a power port without adult assistance.

The embodiment shown in FIG. 5 is for illustration only, other configurations of the locking device 13 are possible. For example, the locking device 13 may have selected portions protruding from slots cut in the body 10. Alternatively, the locking device 13 may not be made of a flexible material.

Figure 6:
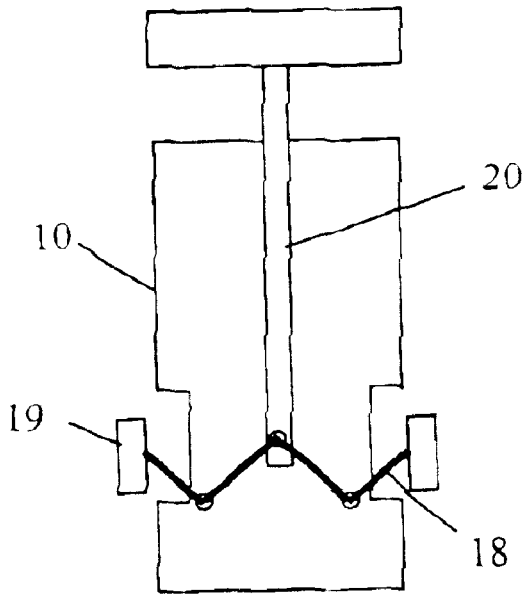
FIG. 6 shows a safety plug illustrating another locking device in accordance with one embodiment of the invention.

FIG. 6 shows another embodiment of the locking device 13 that comprises one or more protruding members 19 adapted to extend from the body 10 to engage a power port (not shown). The protruding members 19 are linked to the control device 20 by levers 18 such that when the control device 20 is pushed in, the protruding members 19 are pulled towards the body 10 to disengage the safety plug from a power port (not shown). The levers 18 and the protruding members 19 shown in FIG. 6 are for illustration only. One of ordinary skill in the art would appreciate that many modifications are possible without departing from the scope of the invention. For example, the protruding members 19 may be hinged at one of its ends to the body 10, and the levers 18 may be replaced by springs. The levers or springs 18 are generally referred to as a "retracting mechanism" in this description.

Advantages of the invention may include the following. A safety plug in accordance with the invention can be easily deployed to block a power port to prevent potential injuries to children. A safety plug of the invention has a locking device with a child-resistant control mechanism that unlocks the locking device in a counter-intuitive manner. Therefore, children are not expected to be able to remove the safety plugs from the power ports. In addition, a safety plug of the invention may further provide other functions such as a sign or a display. The safety plug may also provide a conduit to the power terminals in the power port such that other electrical or electronic devices may be conveniently connected.

While the invention has been described with respect to a limited number of embodiments, those skilled in the art, having the benefit of this disclosure, will appreciate that other embodiments can be devised which do not depart from the scope of the invention as disclosed herein.

What is claimed is:

1. A safety plug, comprising:

a body having a first end adapted to be inserted into a power port;

a locking device connected to the body for reversibly engaging inside of the power port;

a control device operatively coupled to the locking device for disengaging the locking device from the inside of the power port, at least one electrical contact on the first end of the body for conducting electricity from the power port; and an electrical device disposed proximate to a second end of the body and electrically connected to the at least one electrical contact, wherein the electrical device is configured to be powered by the electricity from the power port, wherein the control device comprises a child-resistant mechanism, wherein the electrical device is attached to a second end of the control device.

* * * * *